US006508392B1

(12) United States Patent
Huang

(10) Patent No.: US 6,508,392 B1
(45) Date of Patent: Jan. 21, 2003

(54) WASHER SUPPLY DEVICE FOR POWER NAILERS

(75) Inventor: Chen-Fa Huang, Ta Li (TW)

(73) Assignee: Besco Pneumatic Corp., Taichung Hsieng (TW)

( * ) Notice: Subject to any disclaimer, the term of this patent is extended or adjusted under 35 U.S.C. 154(b) by 169 days.

(21) Appl. No.: 09/777,829

(22) Filed: Feb. 7, 2001

(51) Int. Cl.[7] ..... B25C 7/00

(52) U.S. Cl. ..... 227/18; 227/119; 227/120; 227/136

(58) Field of Search ..... 227/15, 18, 119, 227/120, 136, 137, 130, 138

(56) References Cited

U.S. PATENT DOCUMENTS 3,964,661 A * 6/1976 Schmidt et al. ..... 227/119
5,263,627 A * 11/1993 Breuer et al. ..... 227/18
5,781,989 A * 7/1998 Schmidt ..... 227/18
5,947,362 A * 9/1999 Omli ..... 227/120
6,065,660 A * 5/2000 Cabrera ..... 227/136
6,098,442 A * 8/2000 Walldorf et al. ..... 227/15

* cited by examiner

*Primary Examiner*—Scott A. Smith
(74) *Attorney, Agent, or Firm*—Rosenberg, Klein & Lee

(57) ABSTRACT

A washer supply device for power nailers includes a tube receiving a pile of washers therein and the tube communicates a washer transferring device in which a curve slot is defined. A pushing device has a retractable rod which is pivotally connected to an end of a link and the other end of the link is connected to a pusher which is slidably received in the curve slot to push the washers toward a nose portion of the power nailer. The link has a fulcrum point which is pivotally connected to the washer transferring device so that the pusher can be reciprocatingly moved in the slot to feed the washers by the movement of the retractable rod.

2 Claims, 4 Drawing Sheets

WASHER SUPPLY DEVICE FOR POWER NAILERS

FIELD OF THE INVENTION

The present invention relates to a washer supply device using a curve slot and a pusher to push the washers in the slot toward the nose of the nailer. The washer supply device has a compact size.

BACKGROUND OF THE INVENTION

A conventional washer supply device for a power nailer is shown in FIG. 1 and generally includes a box 11 in which washers 10 are received, and the box 11 is connected to a side of the power nailer 12. A tube 14 is connected between the box 11 and a washer transferring device 15 which is connected to a nose portion 13 of the power nailer 12. The box 11 and the tube 14 are bulky and occupy a large space so that the nailer cannot used in a narrow space because the bulky members cannot fit in the space. Once the washers 10 are jammed in the box 11, the box 11 is to be discarded.

The present invention intends to provide a washer supply device for power nailers and the device uses a retractable rod to control a link to push the washers in a curved slot in the washer transferring device. The whole device occupies a small space.

SUMMARY OF THE INVENTION

In accordance with one aspect of the present invention, there is provided a washer supply device for power nailers and comprising a tube connected to a side of the power nailer and the tube having an open lower end which communicates a curve slot defined in a washer transferring device. A pushing device is connected to a pneumatic hose and a pushing rod is retractably received in the pushing device. A link has a first end pivotally connected to the pushing rod and a second end of the link is pivotally connected to a pusher which is slidably received in the curve slot. A bolt extends through a fulcrum point in the link and is pivotally connected to the washer transferring device.

The primary object of the present invention is to provide a washer supply device for power nailers and the washers can be fed to the nose portion of the power nailer smoothly.

The other object of the present invention is to provide a compact washer supply device for power nailers.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
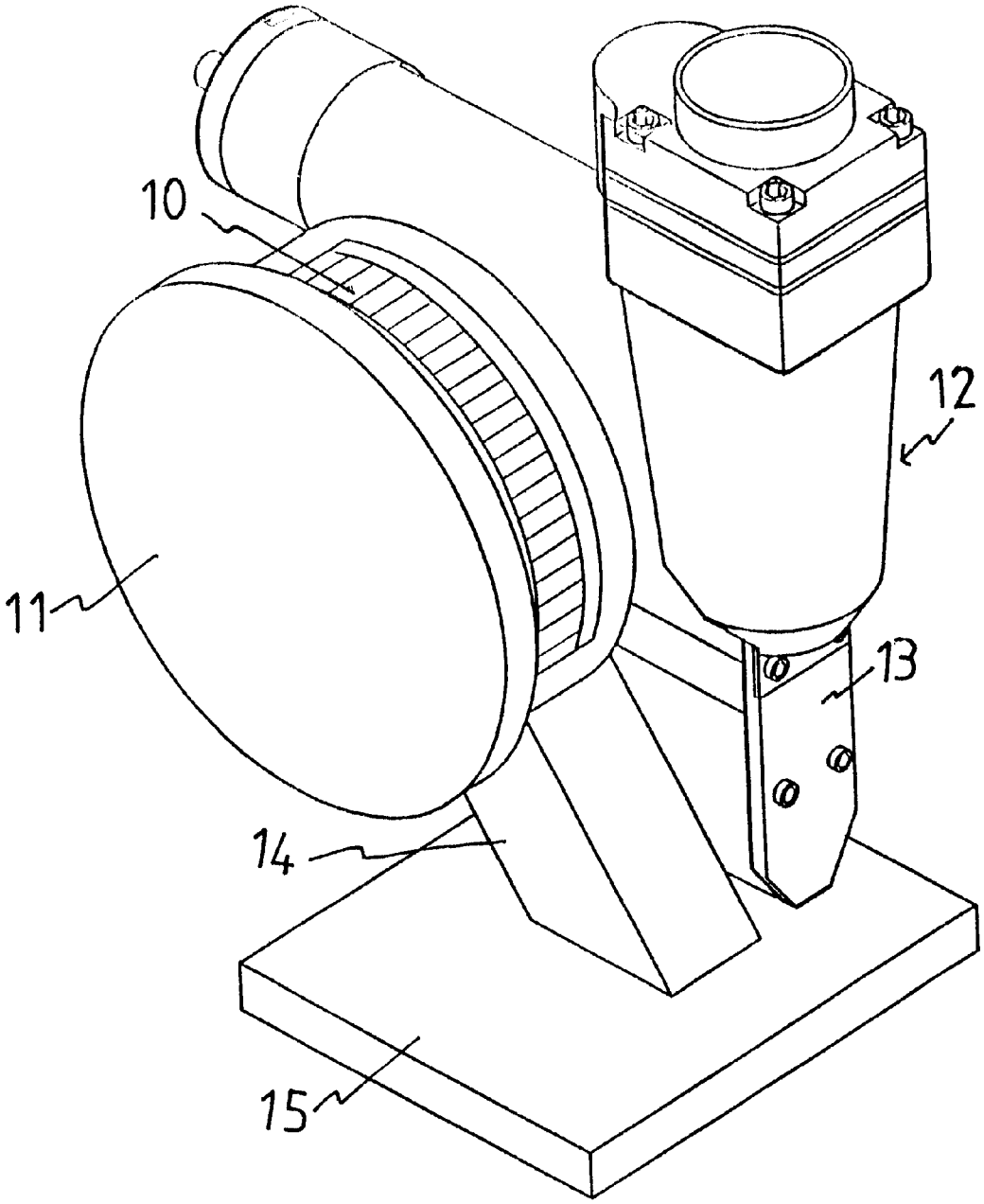
FIG. 1 PRIOR ART
FIG. 1 is a perspective view to show a conventional washer supply device for power nailers.
Figure 2:
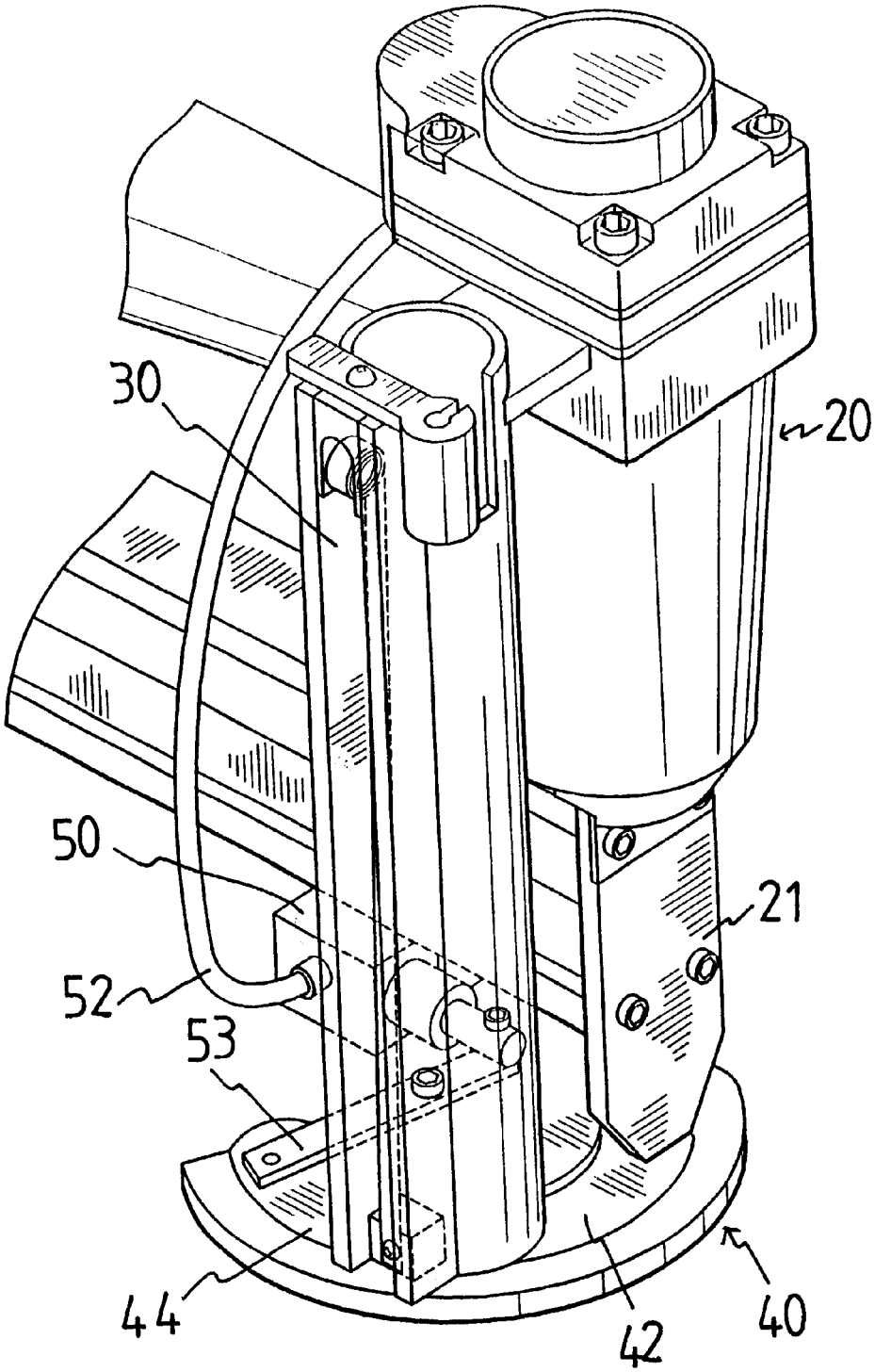
FIG. 2 is a perspective view to show a washer supply device for power nailers of the present invention.
Figure 3:
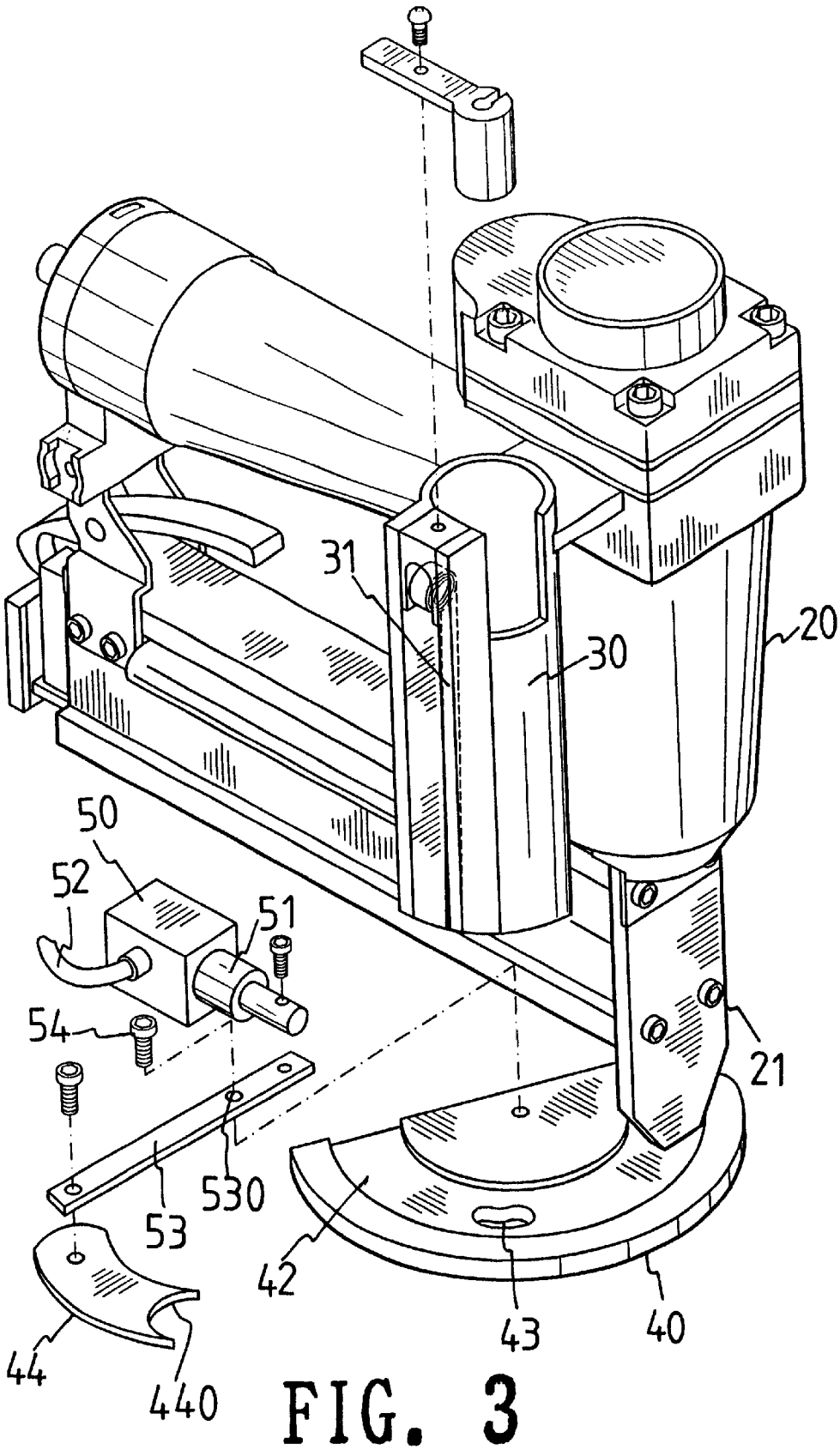
FIG. 3 is an exploded view to show the washer supply device for power nailers of the present invention.

Referring to FIGS. 2 and 3, the washer supply device for power nailers of the present invention comprises a tube 30 connected to a side of the power nailer 20 and a biasing member 31 is received in the tube 30 so as to press a pile of washer (not shown) in the tube 30 toward an open lower end of the tube 30. A washer transferring device 40 has a curve slot 42 defined in a top surface thereof and the tube 30 is located on the washer transferring device 40 so that the open lower end of the tube 30 communicates with the curve slot 42. The nose portion 21 of the power nailer 20 is located at an end of the curve slot 42.

Figure 4:
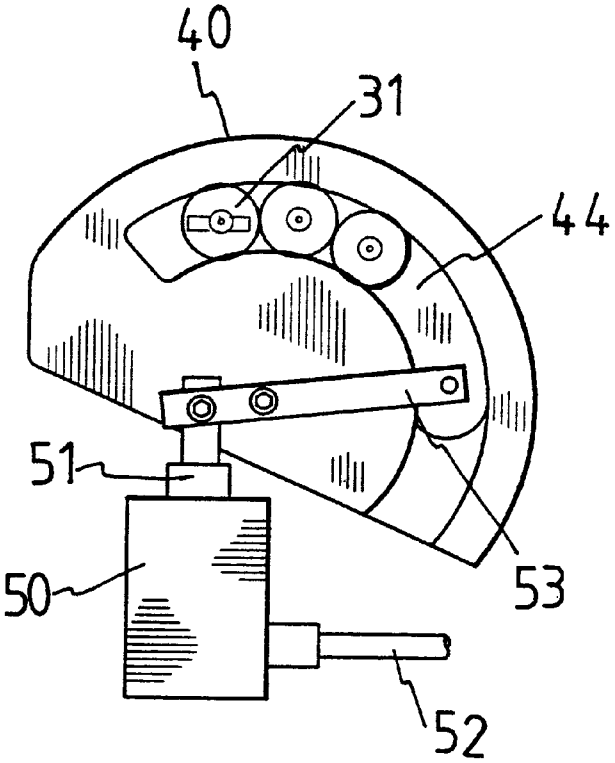
FIG. 4 shows that the washers are pushed by the pusher when the retractable rod is retracted.

A pushing device 50 is connected to a pneumatic hose 52 which is connected to a chamber on a top of the power nailer. A pushing rod 51 is retractably received in the pushing device 50 and is pivotally connected to a first end of a link 53. A second end of the link 53 is pivotally connected to a pusher 44 which is sliably received in the curve slot 42 in the washer transferring device 40. A bolt 54 extends through a fulcrum point 530 in the link 53 and pivotally connected to the washer transferring device 40. The fulcrum point 530 is located between the two ends of the link 53. Referring to FIG. 4, the pusher 44 has a curved recess 440 defined in an end thereof so that the washers 31 can be engaged with the recess 440 and pushed by the pusher 44 in the curve slot 42. A hole 43 is defined through a inner periphery of the curve slot 42 and is used to position the pile of washer when inserting into the tube 30.

Figure 5:
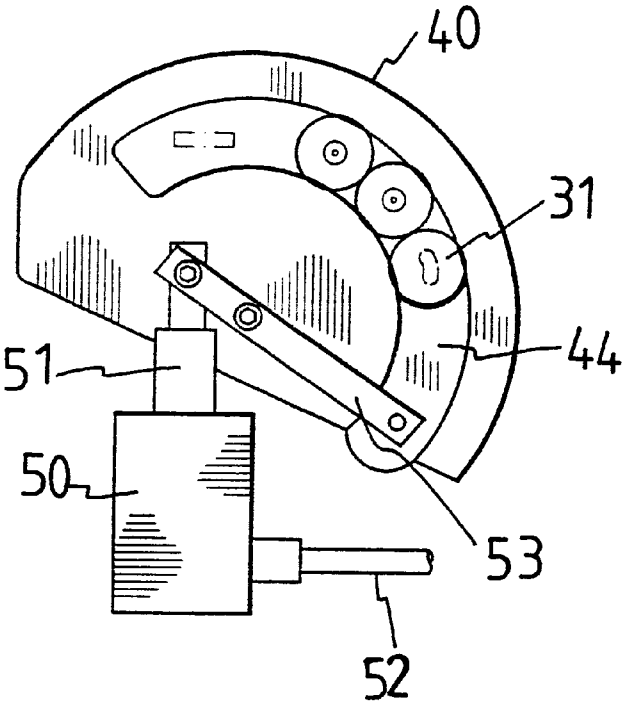
FIG. 5 shows that the washers are moved away from the nose portion of the power nailer when the retractable rod is extended.

As shown in FIG. 5, when the retractable rod 51 extends, the second end of the link 53 is pulled toward the pushing device 50 so that the washers 31 are removed away from the nose portion 21. By the retractable movement of the retractable rod 51, the pusher 44 is smoothly and reciprocatingly moved in the curve slot 42 and the washers 31 are smoothly be fed to the nose portion 21.

While we have shown and described various embodiments in accordance with the present invention, it should be clear to those skilled in the art that further embodiments may be made without departing from the scope and spirit of the present invention.

What is claimed is:

1. A washer supply device for power nailers, comprising:

a tube adapted to be connected to a side of the power nailer and having an open lower end;

a washer transferring device having a curve slot defined in a top surface thereof and said tube located on said washer transferring device, said open lower end communicating with said curve slot, and a pushing device adapted to be connected to a pneumatic hose and a pushing rod retractably received in said pushing device, a link having a first end pivotally connected to said pushing rod and a second end of said link pivotally connected to a pusher which is slidably received in said curve slot in said washer transferring device, a bolt extending through a fulcrum point in said link and pivotally connected to said washer transferring device.

2. The device as claimed in claim 1, wherein said pusher has a curved recess defined in an end thereof.

* * * * *